US005805529A

United States Patent [19]

Purcell

[11] Patent Number: 5,805,529

[45] Date of Patent: Sep. 8, 1998

[54] FOLDED SHELL PROJECTOR (FSP)

[75] Inventor: Christopher John A. Purcell, Dartmouth, Canada

[73] Assignee: Her Majesty the Queen in right of Canada, as represented by the Minister of National Defence of Her Majesty's Canadian Government, Ottawa, Canada

[21] Appl. No.: 932,581

[22] Filed: Sep. 17, 1997

[51] Int. Cl.[6] ..... H01V 7/00

[52] U.S. Cl. ..... 367/163; 367/174

[58] Field of Search ..... 367/163, 174, 367/142, 158, 159; 310/337

[56] References Cited

U.S. PATENT DOCUMENTS

| | | | |
|---|---|---|---|
| 4,922,470 | 5/1990 | McMahon | 367/163 |
| 5,030,873 | 7/1991 | Owen | 367/162 |
| 5,136,556 | 8/1992 | Obara | 367/163 |

OTHER PUBLICATIONS

Frank R. Abbot "Compliant Housings to Enhance Low–Frequency Performance of Electrostrictive Transducers" Rept. NEL 574 US Navy Electronics Laboratory, San Diego, California 1955.

Dennis F. Jones, et al. "The Acoustic Perofrmance of a Class III Barrel–Stave Flextensional Projector", Proceeding of the 1996 Undersea Defence Technology Conference and Exhibition Nexus Media, Swanly, U.K. pp. 103–108.

*Primary Examiner*—Daniel T. Pihulic

*Attorney, Agent, or Firm*—Larson & Taylor

[57] ABSTRACT

An underwater acoustic projector comprising a pair of spaced apart end plates with an acoustic driver positioned between the end plates, the driver having smaller cross-sectional dimensions than the end plates. The end plate's edges are secured to an outer one-piece thin walled shell that provides a waterproof enclosure for the driver. That thin walled shell has a concavely inwardly bent surface between the end plates and a plurality of axially extending corrugations to provide a predetermined axial compliance and radial-to-axial transformation ratio.

22 Claims, 6 Drawing Sheets

FOLDED SHELL PROJECTOR (FSP)

FIELD OF THE INVENTION

The present invention relates to acoustic projectors, especially projectors for use in low frequency military and civilian sonar systems, and in particular to underwater flextensional projectors having improved stable performance with depth and linearity with drive voltage level.

BACKGROUND TO THE INVENTION

Low frequency military and civilian sonar systems require compact, light weight, high power, efficient, wide bandwidth acoustic projectors whose performance is stable with depth and linear with drive voltage levels and which have a low manufacturing and maintenance cost. Flextensional projectors are amongst the best ones presently available to meet these requirements, one of the most promising flextensional projectors being the barrel stave type. The barrel stave projector (BSP) is a compact, low frequency underwater sound source which has applications in low frequency active (LFA) sonar and in underwater communications. In one known BSP design, such as described in U.S. Pat. No. 4,922,470 by G. McMahon et al, a set of curved bars (staves) surround and enclose a stack of axially poled piezo-electric rings. The staves act like a mechanical transformer and help match the impedance of the transducer to the radiation impedance of the water. Axial motion of the stave ends is transformed to a larger radial motion of the stave midpoints. This increases the net volume velocity of the water, at the expense of the applied force, and is essential for radiating effectively at low frequency.

This known BSP projector has slots between the staves which are required to reduce the hoop stiffness and achieve a useful transformer ratio. However, these slots must be waterproofed by a rubber membrane (boot) stretched tightly and glued with epoxy around the projector. This boot also provides effective corrosion protection for the Al staves. However, the variation in performance with depth of the BSP is suspected to depend in part on the boot. At increasing depths, hydrostatic pressure pushes the boot into the slots causing the shell to stiffen tangentially, increasing the resonance frequency, and causing an increasing loss of performance. This depth sensitivity of a barrel stave projector can be reduced somewhat by reinforcing the boot over the slots. It is also possible to pressure compensate the BSP with compressed air or other gas resulting in good acoustic performance at greater depths.

The slots in the BSP, as a secondary effect, provide a valuable nonlinearity in the response of the projector to hydrostatic loading. The staves will deflect inwards together under increasing hydrostatic loading (assuming no pressure compensation) since the projector is air filled. Depending on the thickness and stiffness of the rubber, it is reasonable to expect that as the slots close at great enough depths, that closure of the slots due to increasing depth will force the boot back out of the slots. The projector will now be very stiff and resistant to further effects of depth until the crush depth of the now, effectively, solid shell is reached. This provides a safety mechanism which may save the projector in case an uncompensated BSP is accidentally submerged very deep or a pressure compensation system runs out of air.

Variants of this known BSP have been built to optimise light weight, wide bandwidth, low frequency, high power, and improved electroacoustic efficiency. Efficiency is an especially critical parameter for the high power versions of the BSP because the driver is well insulated from the water thermally. The boot's relatively poor thermal conductivity contributes to the difficulty in cooling the BSP.

There is evidence that the interelement variability in performance amongst a set of 20 of these projectors used in a horizontal line array was due largely to variability in the boot's material properties. Most of these projectors subsequently failed due to chemical incompatibility of the boots with the hydrocarbon-based towed-array fill fluid, underscoring the need for consideration of chemical compatibility whenever elastomer clad projectors are exposed to fluids other than seawater. The neoprene boot is a potential weak point for the BSP in terms of damage due to rough handling. Even a pinhole in the boot can lead to projector failure by flooding. Overhaul of a barrel stave projector usually involves boot replacement. The cost of a custom molded neoprene boot is approximately $20.00 but the labour cost of installing the boot is typically several person hours spread over 2 days (of glue curing time) contributing to the relatively high maintenance cost for these BSPs.

The inside surfaces of the (eight)staves of these BSPs are machined individually from bar stock on a numerically controlled (NC) milling machine. The staves are then mounted together on a fixture and the outside surfaces are turned on a tracer lathe. The machining and handling costs are such that the staves are the most expensive parts of the BSP. These BSPs are, as a result, both relatively costly to manufacture and maintain.

Since the radiating surface of this BSP is waterproofed with a rubber membrane, it is susceptible to chemical attack and degradation and damage due to flooding through pinholes. The BSP suffers from variation of performance with depth caused by water pressure forcing the rubber membrane into the slots between the vibrating staves of the projector unless a pressure compensation system is fitted. The BSP shows nonlinearity of performance versus drive voltage due to effects of the rubber membrane. Thus there could be substantial advantages to accrue if it were possible to develop a one-piece flextensional shell for the BSP that does not require a boot.

SUMMARY OF THE INVENTION

It is an object of the invention to provide an acoustic projector with reduced depth sensitivity when submerged in water, improved efficiency and increased thermal conductance to the surrounding fluid by the use of a one-piece thin walled folded shell as a radiation surface.

An acoustic projector, according to one embodiment of the present invention, comprises a pair of spaced apart end plates with an acoustic driver positioned between the end plates, the driver having smaller cross-sectional dimensions than the end plates which have edges secured to an outer one-piece thin walled shell that provides an enclosure for said driver, the thin walled shell having a concavely inwardly bent surface between the end plates and a plurality of axially extending corrugations to provide a predetermined axial compliance and radial to axial transformation ratio.

An underwater acoustic projector, according to another embodiment of the invention, comprises a pair of spaced apart end plates with an acoustic driver positioned between the end plates, the driver having smaller cross-sectional dimensions than the end plates which have outer edges secured to an outer one-piece thin walled shell that provides a waterproof enclosure for said driver, the thin walled shell having a concavely inwardly bent surface between the end plates and a plurality of axially extending corrugations to provide a predetermined axial compliance and radial to axial transformation ratio and wherein the shell is formed of a material selected from the group of ferrous metals, non-ferrous metals, plastics or composites.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
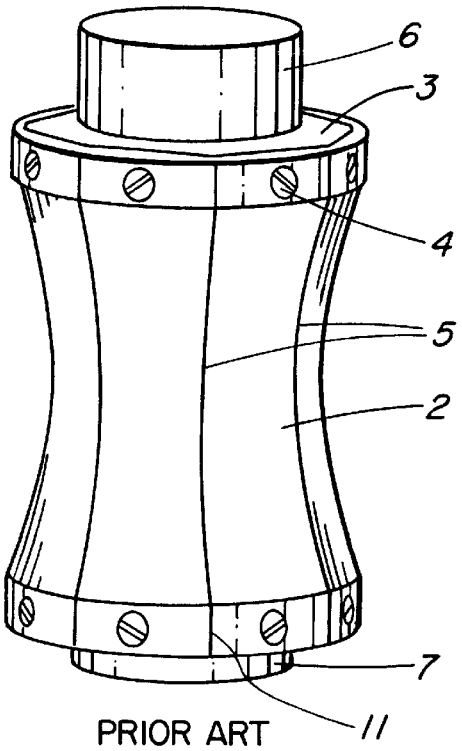
PRIOR ART FIG. 1
FIG. 1 is a perspective view of a known barrel-stave projector without a rubber boot.

Low frequency military and civilian sonar systems require compact, light weight, high power, efficient, wide bandwidth acoustic projectors whose performance is stable with depth and linear with drive voltage levels as well as being low in cost to manufacture and maintain. Flextensional projectors are amongst the best ones presently available to meet these requirements. One type of flextensional projector, known as the barrel stave projector (BSP), is described in U.S. Pat. No. 4,922,470 by G. W. McMahon et al. This barrel stave projector, illustrated in FIGS. 1 and 2, contains a driver 1 formed of a stack of axially poled piezo-electric ceramic rings and an enclosure formed by a set of curved bars (staves) 2 with polygonal end plates 3. The staves 2 are secured to flat sides of the octagonal end plates 3 with an adhesive (epoxy resin) and bolts 4 retained in threaded holes in the end plates. Caps 6 and 7 cover openings in end plates 3.

Axial motion of the stave ends is transformed to a larger radial motion of the staves midpoints. Slots 5 between the staves 2 are required to reduce the hoop stiffness and achieve a useful transformer ratio. Those slots 5 must be waterproofed by a rubber membrane (boot) that is stretched tightly around the projector and glued with epoxy. This boot 8 (shown in FIG. 2) is used for sealing purposes and may be formed of a rubber membrane which, for variants designed for operation near 1 $KH_z$, is about 1 mm thick. It also provides corrosion protection for the Al staves used in these types of BSPs.

The rubber membrane (boot) 8 which waterproofs the radiating surface of the BSP is, however, susceptible to chemical attack and degradation with resulting damage due to flooding through pinholes.

These BSPs also suffer from variation of performance with depth caused by water pressure forcing the rubber membrane into the slots between the vibrating staves of the projector unless a pressure compensation system is included. In addition, these BSPs exhibit non-linearity of performance versus drive voltage due to the effects of that rubber membrane.

Figure 3:
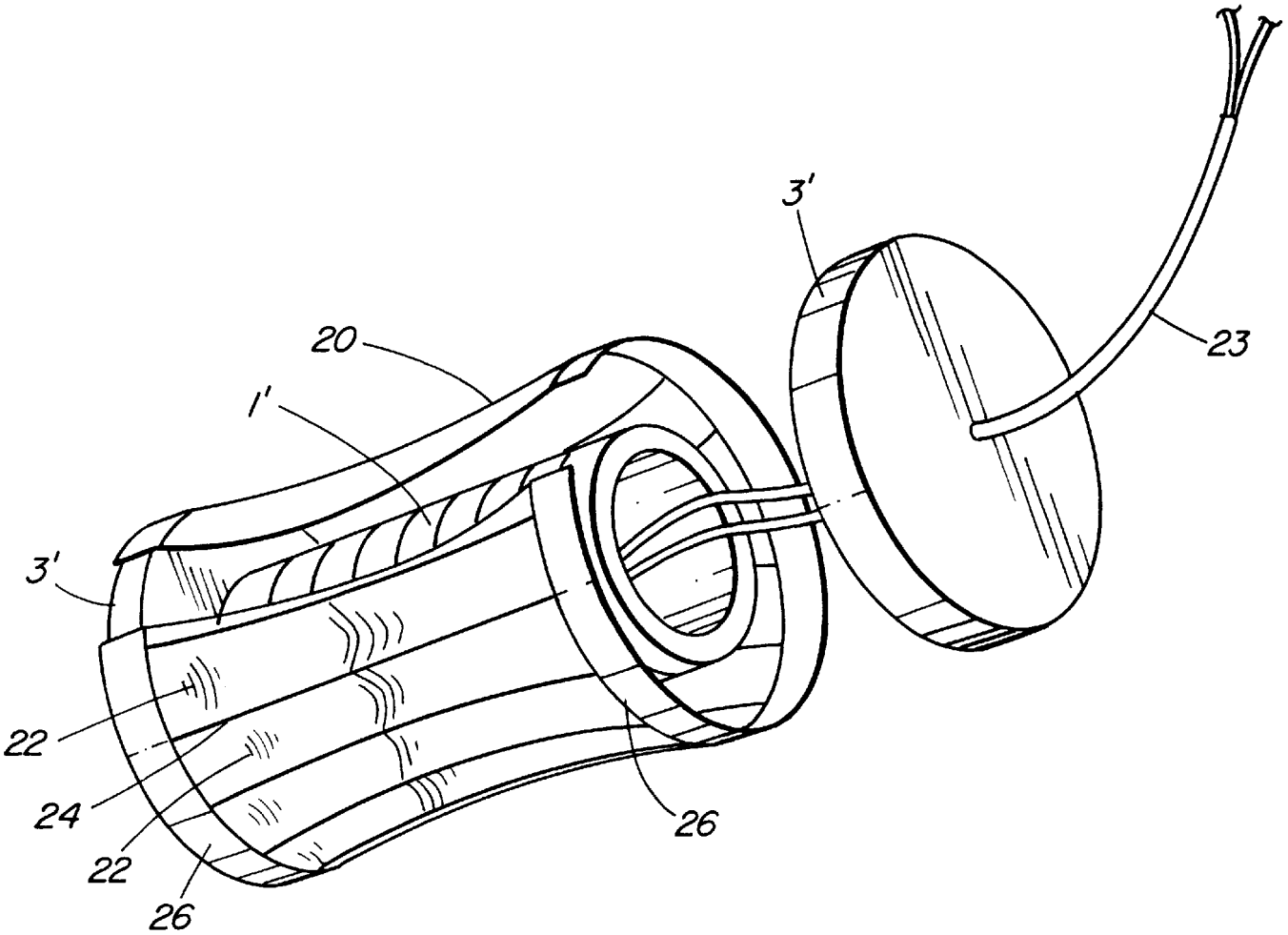
FIG. 3 is a perspective view of one embodiment of a folded shell projector according to the present invention with one fold removed to illustrate its interior.

The present invention provides a one-piece slotless flextensional shell for an underwater acoustic projector which is inwardly concavely shaped similar to the BSP but which does not require any boot. It is formed of a one-piece shell with no gaps or openings in its outer surface. This shell achieves the required low hoop stiffness for low frequency operation by using folds rather than slots as used in the BSP. This Folded Shell Projector's (FSP) surface is formed of a thin-walled one-piece inwardly concavely shaped shell containing corrugations (folds) running in the axial direction. The basic concept of such a FSP is illustrated in FIG. 3 with one fold removed to show the inner piezoelectric driver 1'. The thin-walled folded shell 20 is inwardly concavely shaped with a number of axially extending corrugations having valleys 22 and ridges or cusps 24. The corrugations extend between end flanges 26 which are intended to be connected to end caps 3'. Leads 23 extend from the piezoelectric driver 1' through a central opening in one of the end caps 3'. Computer models of a slotless flextensional shell indicated that if aluminum (Al) was used as the shell material, then a wall thickness for practical designs would lie in the range of 1 to 2 mm and that approximately 16 folds (corrugations) would provide the required performance. The depth of the corrugations varies from a maximum at the center to 0 at the flange. N is the order of a polynominal describing the axial dependence of the depth of the fold.

Figure 4:
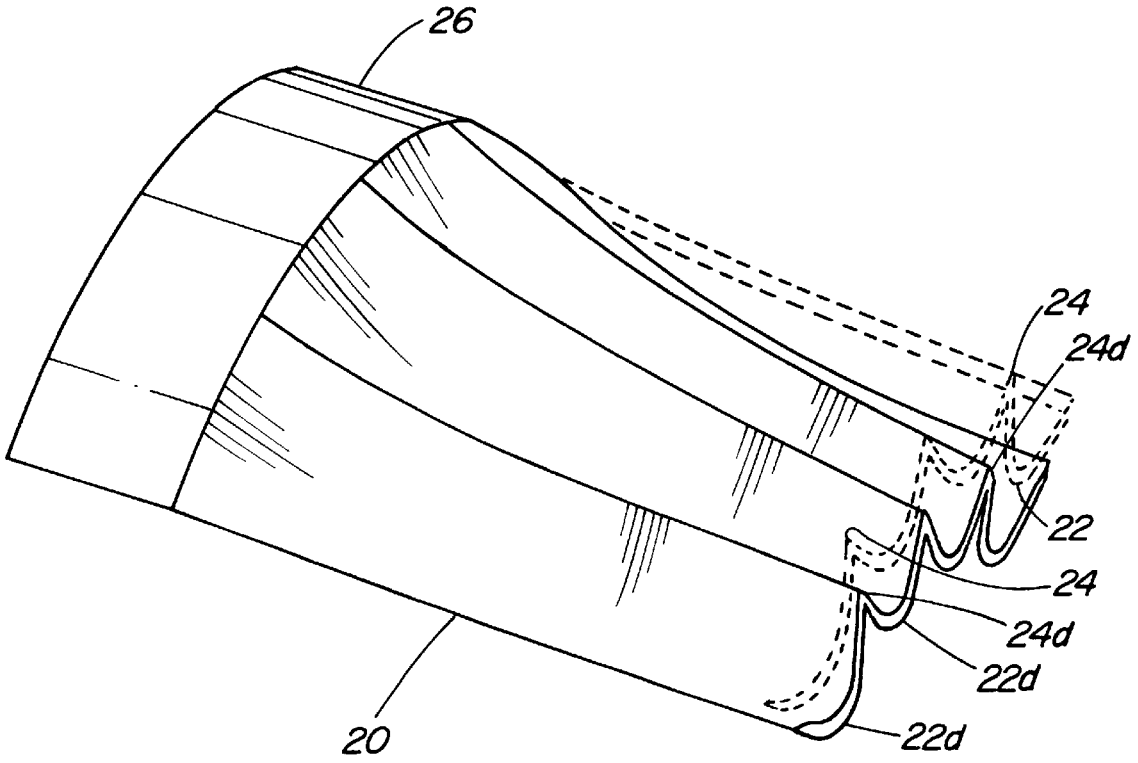
FIG. 4 is a view of one eighth of the outside surface of a folded shell showing deformation and axial/radial transformer action resulting from the force applied by an acoustic driver.
Figure 5:
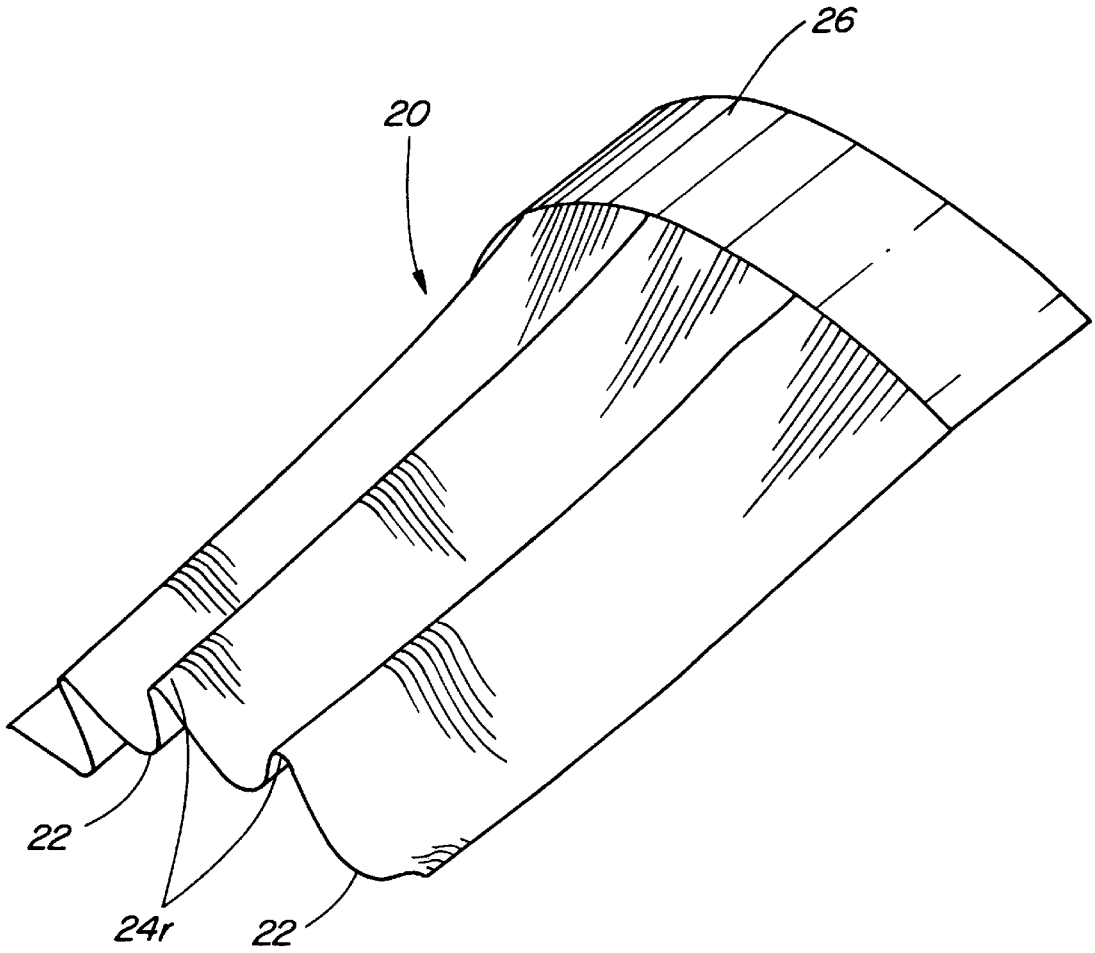
FIG. 5 is a plot of a portion of the surface of a folded shell according to the invention with a rounded cusp.

FIG. 4 is a view of the outside surface of a folded shell derived from a computer generated model showing deformation and axial/radial transformation action resulting from the force applied by an acoustic driver. Valleys 22 and cusp 24 show the shell 20 in an undeformed state whereas **22*d* and 24*d* shown shell 20 when deformed. To avoid the sharp cusps shown in FIG. 4, a better termination for the fold's apex was considered to be in a radius as illustrated at 24*r* in FIG. 5**. This change would eliminate sharp edges on the outer wall which would have been hazardous to handle and easily damaged. This change to the cusps of the corrugations would result in a modest increase in shell mass and in the resonant frequency of the projector.

Low-cost high volume production of these thin-walled FSP shells would generally be done by stamping a thin walled shell from non-ferrous or ferrous metals such as aluminum or steel, or by molding or by casting in plastics or composites such as metal-matrix or fiber-reinforced plastics. There are many suitable metals or other materials from which a FSP may be manufactured with the best choices being ones that have low internal acoustic damping, high stiffness, low density and which can be readily formed and machined. A low cost version of a FSP could be made using injected molded thermosetting fiber reinforced plastic but the acoustic damping of that material would reduce the efficiency of the projector. This may be an acceptable trade-off for some applications. Aluminum alloys have been used with great success in BSP and would be a suitable material for forming a FSP. A protective coating on a metal FSP may be required for projectors which are exposed directly to sea water for long periods of time. Those protective coatings could be in the form of an anodised layer, an electroplated layer, paint, etc. To construct a prototype FSP, however, electroforming was chosen as the most economical method to produce the thin-walled shell. Other production methods (stamping or molding) would have required the use of expensive dies and would not be practical for manufacturing one of a kind prototype shells. The choice of electroforming metals (Cr, Au, Ag, Cu, Ni) is rather limited and, of these, Ni was considered as a best choice since it is corrosion resistant, has high stiffness, high strength and low damping.

Figure 6:
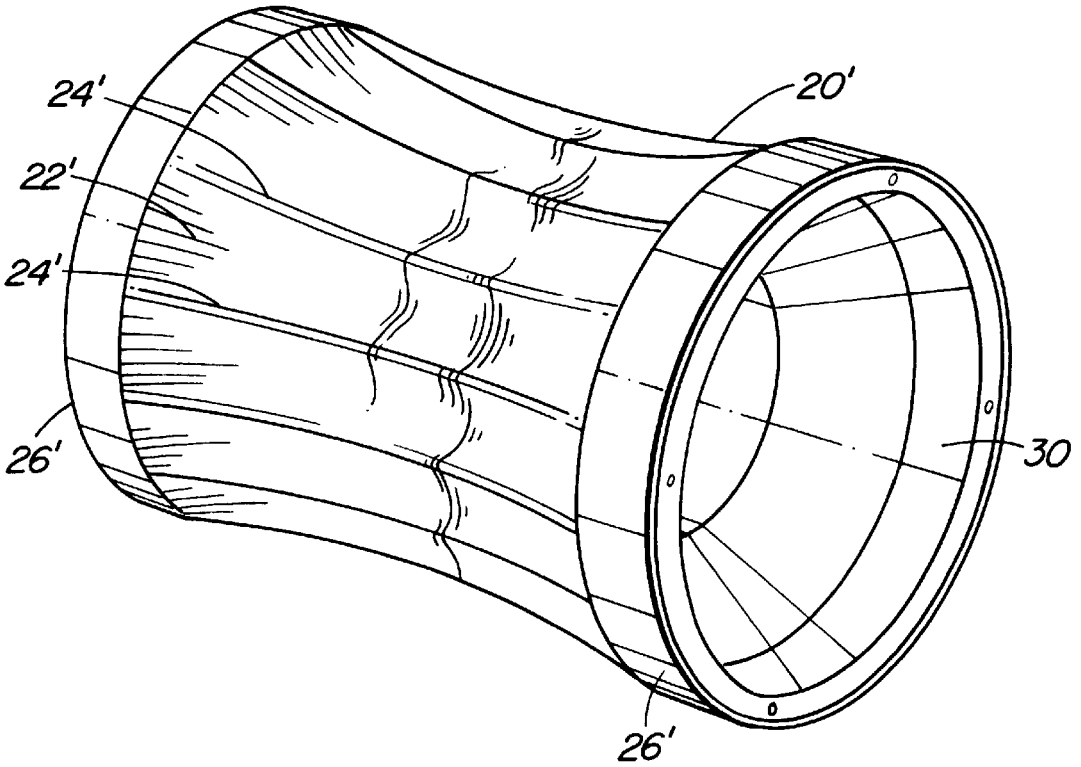
FIG. 6 is a perspective view of a prototype folded shell plated onto an aluminum mandrel after the outside contours have been machined but prior to dissolution of the mandrel.

To manufacture the prototype Ni FSP, a numerically controlled (NC) mill was programmed to make the required tooling which comprises a disposable hollow aluminum (Al) mandrel (upon which the Ni is plated), disposable Al plate endcaps with Teflon™ gaskets (to protect keyed ends of the mandrel from the plating process) and fixtures keyed to the mandrel and to the dividing head of the mill to permit accurate registration before and after plating. The outside surface of an aluminum cylinder was NC milled to the contours of the desired inside surface of the shell using standard ball nosed cutters to form the mandrel. That inside surface is inwardly concavely shaped with 16 corrugations running in the axial directions. The shell thickness was electroformed with Ni by plating onto the aluminum mandrel which produces a perfect replica of that outside surface to form the inside surface of the prototype FSD. The outside surface of that plated mandrel, however, is irregular at this stage. The plated mandrel was reinstalled in the NC mill and the outside contours milled using chrome vanadium ball mills due to the hardness of the Ni electroformed shell. The bulk of the Al mandrel was then bored out on a lathe with the resulting product, illustrated in FIG. 6, having an Al hollow mandrel 30 and a Ni shell 20'. The remaining Al, the remains of the mandrel, was then dissolved away in hot NaOH leaving only the Ni shell. That shell weighed 435.2 gm with a wall thickness of 1.27 mm at the midpoints of the folds. The axial compliance of the shell was measured to be $6.2\times10^{-9}\pm1.0\times10^{-9}$ m/N using a dial indicator to measure axial deflections.

The prototype FSP was completed using standard transducer construction techniques by inserting a fiberglass wrapped stack of 10 parallel connected axially poled piezo electric ceramic rings into the FSP prototype shell with two mild steel end plates, two aluminum endcaps and four 3.2 mm diameter stainless steel stress rods being assembled to complete the prototype. The ceramic rings have a smaller diameter than the minimum diameter of the prototype shell. This type of assembly is shown and described in U.S. Pat. No. 4,922,470. The axially poled rings have a 50.8 mm o.d., a 38.1 mm i.d. and 10.1 mm thickness. The aluminum endcaps plug large access holes in the steel end plates. In this FSP prototype, a cast epoxy gland was provided to waterproof the entry point for electrical leads, and air fittings were included for a pressure compensation system.

The desired parameters for the FSP prototype shell which were originally selected are listed below in Table 1.

TABLE 1

| Geometrical Parameters | Value |
|---|---|
| N (axial fold depth exponent) | 4 |
| n (number of folds) | 16 |
| $r_1$ (radius of flange) | 0.0399 m |
| Z0 (½ fold height) | 0.0511 m |
| R (radius of curvature of the inwardly concave surface of shells upon which the folds are superimposed) | 0.30 m |
| w (shell wall thickness) | 0.00125 m |
| $a_o$ (fold depth) | 0.0075 m |
| flange (height) | 0.0132 m |

TABLE 1-continued

| Geometrical Parameters | Value |
|---|---|
| mass | 435.2 gm |

The wall thickness measured at midpoints of the folds was found to be 1.27 mm (+0.05 mm–0.13 mm). This agreed well with the selected desired wall thickness of 1.25 mm. This shell's axial compliance was measured by compressing it in a hydraulic press to apply a known axial load. That measured value was $6.2\times10^{-9}\pm1.0\times10^{-9}$ m/N.

Table 2 summarizes the acoustic performance of the uncompensated prototype FSP obtained from shallow water (30 m depth) calibration and some preliminary trials in deep water.

TABLE 2

| |
|---|
| Resonant frequency 2100 Hz |
| TVR 123.8 dB re 1 $\mu$Pa/V @ 1 m |
| SL (@ 3 kV) 193.4 dB re 1 $\mu$Pa @ 1 m |
| Bandwidth 530 Hz |
| Q 4.0 |
| DI (at 2100 Hz) .98 |
| G 24.5 $\mu$mho |
| B 157.2 $\mu$mho |
| Efficiency 65% |
| Mass of complete projector 2.463 KG |
| Figure of Merit 7.1 W/(Kg-kHz – Q) @ 3000 V |
| Depth Dependence of Resonant Frequency (uncompensated) 0.125 $H_z$/m (in 50–250 m depth range). |

The following is a list of the symbols appearing in Table 2 with a brief explanation as to what those symbols represent:

TVR—Transmitting Voltage Response in units of decibels referenced to $\mu$ Pascal/Volt at 1 meter, SL—Source Level in units of decibels referenced to 1$\mu$ Pascal at 1 meter, Q—a commonly used term for the dimensionless ratio of a resonance frequency to the bandwidth of the resonance peak, where bandwidth is the frequency interval between the points on the conductance versus frequency curve where the conductance has fallen to half its peak value, DI—the Directivity Index measured in the x-z plane, G—the Conductance in units of $\mu$mho. Conductance is the real part of the admittance, i.e. the real part of the ratio of the current through a device to the voltage across it.

B—the Susceptance in units of $\mu$mho. Susceptance is the imaginary part of the admittance.

The relatively high resonance frequency (compared to a nominal 1100 Hz for a BSP) reflects this prototype FSP transformer ratio and the shell compliance being lower than the corresponding values for a BSP. Suitable modification to the geometrical parameters can, however, reduce that resonant frequency. The TVR is equal to the best available BSP but if the design frequency is reduced, the TVR would be expected to decrease. The directivity was measured at resonance in two planes, the x-y and x-z planes. The quoted efficiency of 65% was estimated using the directivity index (DI) measured in the x-z plane, neglecting the effect of the smaller x-y plane directivity. If the directivity had been integrated over all angles, the resulting efficiency would be several percent higher.

Calibrations of this FSP were performed at drive levels ranging from 30–3000 V and the TVR was unaffected by the driver level over than range. This is in contrast to the behaviour of BSPs which exhibit noticeable frequency shifts and TVR level changes over this drive level range.

This FSP flextensional projector uses a one-piece thin walled metal shell as a radiating surface and achieves low tangential stiffness by using folds rather than the staves used in a BSP. This FSP one-piece shell is inherently watertight so that a rubber boot is not required which leads to reduced depth sensitivity, improved efficiency, increased thermal conductance to the surrounding fluid, higher reliability and better interelement matching than present BSPs.

The prototype FSP was provided with a piezoelectric acoustic motor but other types of drive motors could be employed in a FSP. A magnetostrictive drive motor, for instance, could be fitted into the space where the piezoelectric stack resided in the previously described prototype. Other types of acoustic drive motors that are suitable for use in FSPs include electrostrictive drive motors based on material such as PMN (lead metaniobate), electrodynamic drive motors (permanent magnet and coil) or hydroacoustic motors.

The previously described prototype FSP contained 16 axially extending corrugations. The number of corrugations could, however, be varied anywhere from 8 corrugations upward to obtain optimum performance when different materials, wall thickness and geometry are used to produce a folded shell. Various types of geometry would be suitable for these types of FSPs. The radius of curvature R of the inwardly concave surface of the shell upon which the folds are superimposed may be, for instance, 5 to 20 times the radius of the flange and the maximum fold depth may be anywhere from 2 to 10 times the thickness of the shell wall.

Figure 2:
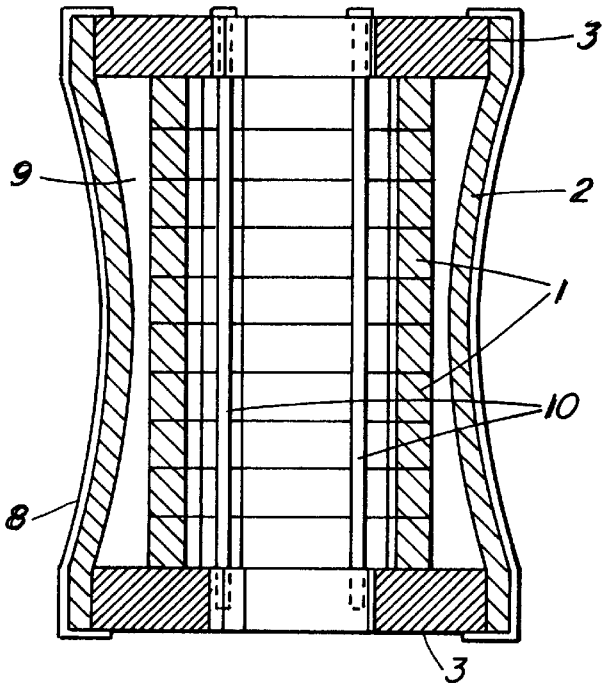
PRIOR ART FIG. 2
FIG. 2 is a cross-sectional view along a longitudinal axis of FIG. 1 with a rubber boot in place but without the upper and lower end caps shown in FIG. 1.

A variant of the known BSP described with respect to FIGS. 1 and 2 is described in U.S. Pat. No. 5,135,556 by R. J. Obara wherein the staves are shaped and arranged to have a circular cross-section arrangement at the top and bottom of the BSP but an elliptical cross-sectional arrangement midway the top and bottom. This forms a projector that has a radius of curvature that varies continuously between fixed values as the angle about the axis of the projector varies and which is alleged to provide a wide bandwidth. Another variant of the known BSPs is a dual shell version developed by Dennis F. Jones to provide an increased bandwidth. That dual shell BSP is described by D. F. Jones and C. G. Reithmeier in an article entitled "The Acoustic Performance of a Class III Barrel Projector" that was published in Proceedings of the 1996 Undersea Defence Technology Conference and Exhibition, Nexus Media, Swanly, U.K. pages 103–108, (1996). This dual shell BSP consists of 2 slightly different BSPs fastened together, end to end, to create a single unit having a wide bandwidth. This dual shell concept is also applicable to FSPs and one embodiment of a dual shell FSP is illustrated in FIG. 7 wherein one quadrant is cut away and one end cap is separated to illustrate the interior.

Figure 7:
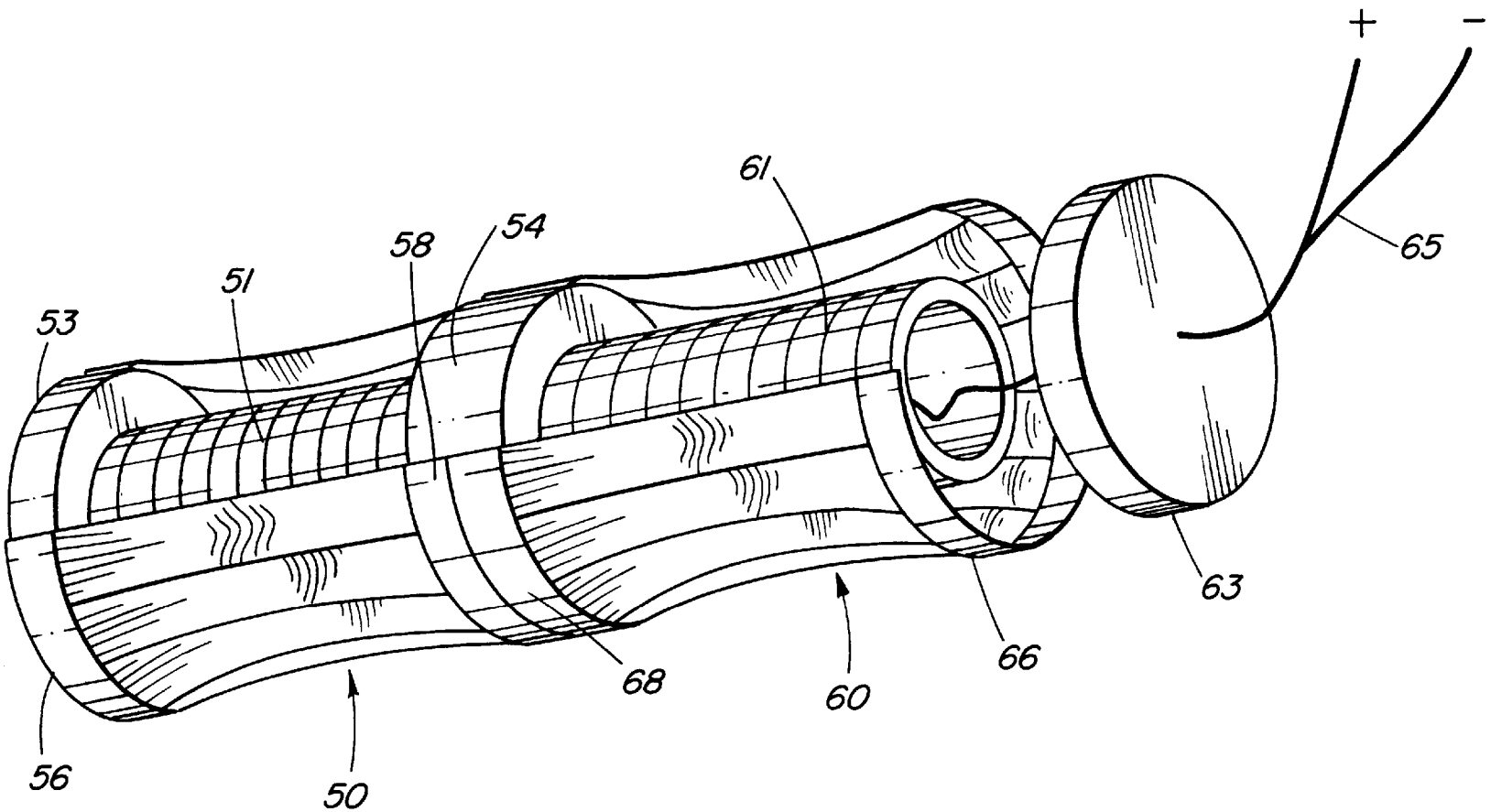
FIG. 7 is a perspective view of another embodiment of a folded shell projector according to the present invention, a dual shell version with one quadrant cut away and one end cap separated to illustrate the interior.

The dual shell FSP illustrated in FIG. 7 is formed by a bottom shell 50 and top shell 60 which are joined together at flanges 58 and 68 secured to a central support plate 54 of approximately twice the thickness of the end caps 53, 63. A piezoelectric motor 51 is included inside shell 50 and a second piezoelectric motor 61 is included in shell 60 with the central divider 54 being located between the two motors. An end cap 53 hermetically seals the bottom of shell 50 while end cap 63 (shown separated) is used to seal the top end of shell 60, the end caps having a larger diameter than the piezoelectric motor. Electrical leads 65 for the motors extend through an opening in end cap 63 where an epoxy gland (not shown) is utilized for waterproofing.

In the dual shell FSP illustrated in FIG. 7, shell 50 and shell 60 are similar in shape to the prototype FSP but differ slightly such that the lowest breathing mode resonance frequencies are separated. When combined in the composite transducer, these two separated modal responses result in a broad bandwidth. The difference between the two shells 50 and 60 can be obtained by the shells having different lengths, wall thicknesses, radi of curvature, fold depths or a combination of these differences. Any one or combination of these parameters could be used to produce two separate resonances in the TVR with a useful flat region between them. This flat region provides an increased bandwidth over that which would be obtained from one of the shells.

The embodiments of the invention previously described all had identical folds or corrugations in any one single shell. However, folds that are deeper than others with different curvatures can be formed in a single shell in order to optimise performance. These different folds could be alternated or one type of fold may be grouped on opposite side of the FSP and another type on the remaining sides. This later arrangement would provide some directivity to the acoustic signal which emanates from a FSP.

The preferred embodiments of the FSP have been described as ones specifically directed to underwater acoustic projectors but these FSPs can also be operated in air where they can operate as low frequency loudspeakers in, for instance, an alarm system. When a FSP is intended to be operated in the atmosphere, the one-piece shell will protect the acoustic driver from dust particles or other types of air supported pollutants which might exist in highly contaminated environments.

Several embodiments of the invention have been described but various modifications may be made to the preferred embodiments without departing from the spirit and scope of the invention as defined in the appended claims. Various manufacturing processes that could be used to produce the folded shell for these FSPs at low cost include stamping, hydroforming, rolling of metals and molding or casting of reinforced plastics or composites.

The enbodiments of the invention in which an exclusive property or privilege is claimed are defined as follows:

1. An acoustic projector comprising a pair of spaced apart end plates with an acoustic driver positioned between the end plates, the driver having smaller cross-sectional dimensions than the end plates which have edges secured to an outer one-piece thin walled shell that provides an enclosure for said driver, the thin walled shell having a concavely inwardly bent surface between the end plates and a plurality of axially extending corrugations to provide a predetermined axial compliance and radial-to-axial transformation ratio.

2. An acoustic projector as defined in claim 1, wherein the thin walled shell is formed of material selected from the group of ferrous metals, non-ferrous metals, plastics or composites.

3. An acoustic projector as defined in claim 2 wherein the corrugations have a maximum fold depth of about 2 to 10 times the shell wall's thickness.

4. An underwater acoustic projector comprising a pair of spaced apart end plates with an acoustic driver positioned between the end plates, the driver having smaller cross-sectional dimensions than the end plates which have edges secured to an outer one-piece thin walled shell that provides a waterproof enclosure for said driver, the thin walled shell having a concavely inwardly bent surface between the end plates and a plurality of axially extending corrugations to provide a predetermined axial compliance and radial-to-axial transformation ratio.

5. An underwater acoustic projector as defined in claim 4, wherein the thin walled shell is formed of a material selected from the group of ferrous metals, non-ferrous metals, plastics or composites and the corrugations have a maximum fold depth of about 2 to 10 times the shell wall's thickness.

6. An underwater acoustic projector as defined in claim 4, wherein the corrugations have rounded cusps.

7. An underwater acoustic projector as defined in claim 6, wherein the thin walled shell has a flange at each end which is secured to the end plates.

8. An underwater acoustic projector as defined in claim 7, wherein the thin walled shell has at least 8 axial extending corrugations.

9. An underwater acoustic projector as defined in claim 8, wherein the shell is formed of metal that is 1 to 2 mm thick.

10. An underwater acoustic projector as defined in claim 9, wherein the acoustic driver is selected from the group of electrodynamic driver motor, electrostrictive driver motor, hydroacoustic motor, magnetostrictive driver motor or piezoelectric motor.

11. An underwater acoustic projector as defined in claim 4, wherein the thin walled shell has at least 8 axial extending corrugations.

12. An underwater acoustic projector as defined in claim 11, wherein the corrugations have a maximum fold depth of about 2 to 10 times the shell wall's thickness.

13. An underwater acoustic projector as defined in claim 12, wherein the thin walled shell has a flange at each end which is secured to the end plates.

14. An underwater acoustic projector as defined in claim 13, wherein the corrugations have a maximum depth at a midpoint along a longitudinal axis of the shell, which depth varies axially and is 0 at said flange.

15. An underwater acoustic projector as defined in claim 14, wherein the concavely inwardly bent surface has a radius of curvature R of about 5 to 20 times the radius of said flange.

16. An underwater acoustic projector as defined in claim 15, wherein the thin walled shell is formed of metal about 1 to 2 mm thick.

17. An underwater acoustic projector as defined in claim 16, wherein the thin walled shell is formed of aluminum having an outer anodised protective layer.

18. An underwater acoustic projector as defined in claim 17, wherein the driver is one selected from the group of electrodynamic driver motor, electrostrictive driver motor, hydroacoustic motor, magnetostrictive driver motor or piezoelectric motor.

19. An underwater acoustic projector as defined in claim 18, wherein the driver is a piezoelectric driver comprised of a stack of parallel connected axially poled ceramic rings.

20. An underwater acoustic projector as defined in claim 19, wherein the end plates have access openings through which electrical leads to the driver extend, each opening being plugged by an endcap, a waterproof gland sealing an entry point for the electrical leads through an end cap.

21. An acoustic projector as defined in claim 3 wherein corrugations with at least two different maximum fold depths form said plurality of axially extending corrugations.

22. An underwater acoustic projector comprising two one-piece thin wall shells extending between end caps and a central divider to which the shells are hermetically sealed, each shell having a concavely inwardly bent surface with a plurality of corrugations extending along the length of the shell, an acoustic driver of smaller cross-sectional dimensions than the shells being coupled between the central divider and each end plate which, with the shells, provide a waterproof enclosure for the drivers; the shells having slightly different physical properties to provide slightly different predetermined axial compliance and radial-to-axial transformation ratios.

* * * * *